US008796590B2

(12) United States Patent
Boyer, III et al.

(10) Patent No.: US 8,796,590 B2
(45) Date of Patent: Aug. 5, 2014

(54) OVEN WITH LOW-TEMPERATURE SELF-CLEANING MODE

(71) Applicant: Whirlpool Corporation, Benton Harbor, MI (US)

(72) Inventors: Mark A. Boyer, III, Harrison, TN (US); Sky W. Carman, Cleveland, TN (US); James C. Johncock, Shelbyville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/800,030

(22) Filed: Mar. 13, 2013

(65) Prior Publication Data

US 2013/0192582 A1 Aug. 1, 2013

Related U.S. Application Data

(62) Division of application No. 12/769,017, filed on Apr. 28, 2010, now Pat. No. 8,415,591.

(51) Int. Cl.

| | |
|---|---|
| ***A21B 1/00*** | (2006.01) |
| ***A21B 1/22*** | (2006.01) |
| ***F27D 11/00*** | (2006.01) |

(52) U.S. Cl.

USPC ..... 219/391; 219/392; 219/393; 219/400

(58) Field of Classification Search

USPC ..... 219/392, 393, 413, 391, 126

See application file for complete search history.

(56) References Cited

U.S. PATENT DOCUMENTS

| | | | | |
|---|---|---|---|---|
| 3,812,316 | A * | 5/1974 | Milburn | 219/741 |
| 8,193,470 | B1 * | 6/2012 | Harlamert et al. | 219/401 |
| 2007/0044789 | A1 * | 3/2007 | Grieco | 126/273 R |
| 2009/0178576 | A1 * | 7/2009 | Valentine et al. | 99/421 H |
| 2011/0139141 | A1 * | 6/2011 | Shaffer et al. | 126/273 R |

FOREIGN PATENT DOCUMENTS

EP 2662340 A1 11/2013

OTHER PUBLICATIONS

GE Owner's Manual GE Appliances revision of Jan. 2009, p. 27.*

Evele et al, "Performance Coatings for Energy Efficiency", 70th Procelain Enamel Institute 2008, appearing on pp. 51-58 of Ceramic Transactions, vol. 211, pp. 1, 2, 55 and 56 downloaded Feb. 204.

* cited by examiner

*Primary Examiner* — David S Blum

(57) ABSTRACT

An oven having one or more low-temperature self-cleaning modes has an interior cavity and at least two heating elements in the interior cavity. A sump is formed in the bottom wall of the cavity. The oven has an electronic control unit, which activates and deactivates the heating elements during operation of the low-temperature self-cleaning mode. The electronic control unit may disable an oven door lock during a low-temperature self-cleaning mode.

18 Claims, 5 Drawing Sheets

OVEN WITH LOW-TEMPERATURE SELF-CLEANING MODE

CROSS-REFERENCE TO RELATED APPLICATIONS

The present application claims priority from and represents a continuation of U.S. patent application Ser. No. 12/769,017 (now U.S. Pat. No. 8,415,591), entitled "OVEN WITH LOW-TEMPERATURE SELF-CLEANING MODE," filed Apr. 28, 2010, the entirety of which is incorporated herein by reference.

TECHNICAL FIELD

The present disclosure pertains to oven appliances, and more particularly, to self-cleaning ovens.

BACKGROUND

Ovens are kitchen appliances that are used to cook food. During the cooking process, the interior of the oven, where the food is cooked, may become soiled. For example, food may spill out of a baking pan or splatter during the cooking process. Due to the heat used for cooking, food particles may become baked onto the walls inside the oven. As a result, surfaces inside the oven may be difficult to clean by hand.

Many ovens have a self-cleaning feature. During self-cleaning, the oven interior is subjected to high temperatures. In some ovens, high temperatures are used to provide pyrolytic cleaning, in which food particles are reduced to ash that collects on the bottom of the oven. The ash can be easily removed after the self-cleaning function has finished.

Some ovens have a self-cleaning feature that uses steam, rather than pyrolytic temperatures, to clean the oven walls. The use of steam requires heating the oven to a high enough temperature to cause water inside the oven to boil, in order to create the steam used for cleaning.

SUMMARY

According to one aspect of this disclosure, an oven includes a housing defining a cavity. The cavity has a back wall, a top wall and a bottom wall spaced from the top wall by a pair of side walls. A number of oven racks are positioned inside the cavity. A door is pivotably coupled to the housing, and a window is supported by the door. The oven also includes a first heating element supported by the top wall, a second heating element adjacent the bottom wall, a sump formed in the bottom wall, and a non-pyrolytic coating on each of the back, top, bottom and side walls facing the cavity.

The non-pyrolytic coating may include a hydrophilic enamel. The non-pyrolytic coating may include a porcelain enamel between the hydrophilic enamel and each of the back, top, bottom and side walls.

The sump may be sized to retain a volume of fluid in the range of about two cups or more. The sump may have a depth in the range of about one inch and a length in the range of about twelve inches.

The oven may have a temperature sensor supported by the back wall of the cavity and an electronic control unit, where the electronic control unit monitors temperature signals from the temperature sensor and maintains a temperature in the cavity of less than the boiling point temperature of fluid in the sump during operation of a self-cleaning mode of the oven.

The oven may include a first user control that is selectable to activate a first low-temperature self-cleaning mode in which fluid in the oven is heated to its boiling point temperature, and a second user control that is selectable to activate a second low-temperature self-cleaning mode in which fluid in the oven is heated to a maximum temperature that is less than the boiling point temperature of the fluid.

The oven may include a display that indicates to a user which of the first and second low-temperature self-cleaning modes is activated.

The oven may have a first user control that is selectable to activate a first non-pyrolytic self-cleaning cycle having a duration in the range of about twenty minutes, and a second user control that is selectable to activate a second non-pyrolytic self-cleaning cycle having a duration in the range of about sixty minutes. The oven may have a humidity sensor in the cavity.

According to another aspect of this disclosure, a low-temperature self-cleaning method performed by an oven includes receiving a control signal indicating selection of a self-cleaning mode of the oven, receiving a temperature signal from a temperature sensor located in the oven, where the temperature signal indicates a temperature inside the oven, comparing the temperature signal with a maximum temperature for operation of the self-cleaning mode, determining whether to disable an oven door lock, prompting a user to add fluid to the oven, and alternately heating first and second heating elements in the oven for a predetermined period of time.

The maximum temperature inside the oven for operation of the self-cleaning mode may be less than the temperature at which water boils. The maximum temperature inside the oven for operation of the self-cleaning mode may be in the range of about 150 to 170 degrees Fahrenheit.

The method may include receiving a door position signal from a door position sensor on the oven, and determining whether the oven door is closed based on the door position signal.

The first heating element of the oven may have a higher wattage than the second heating element. The step of alternately heating first and second heating elements in the oven for a predetermined period of time may include repeatedly heating the first heating element for a first predetermined period of time while the second heating element is turned off and heating the second heating element for a second predetermined period of time while the first heating element is turned off, for the duration of the self-cleaning mode.

Where the first heating element has a higher wattage than the second heating element, the first predetermined period of time may be shorter than the second predetermined period of time.

In accordance with a further aspect of this disclosure, a low-temperature self-cleaning method performed by an oven includes receiving a control signal to initiate a self-cleaning cycle of the oven, determining a temperature inside the oven based on a temperature signal from a temperature sensor located in the oven, determining whether the oven temperature is less than or equal to a maximum temperature for operation of the self-cleaning mode, determining whether the oven door is closed based on a door position signal from a door position sensor located on the oven, prompting a user to add liquid into the oven, heating a first heating element located in the oven for a first predetermined period of time during which a second heating element located in the oven is off, heating a second heating element located in the oven for a second predetermined period of time during which the first heating element is off, repeating the steps of heating a first heating element for a first period of time and heating a second heating element for a second period of time for the duration of a first portion of the self-cleaning cycle, heating the first heating element located in the oven for a third predetermined period of time during which the second heating element is off, heating the second heating element located in the oven for a fourth predetermined period of time during which the first heating element is off, and continuously and sequentially repeating the steps of heating a first heating element for a third period of time and heating a second heating element for a fourth period of time for the duration of a second portion of the self-cleaning cycle.

The first heating element may be a broil element, the second heating element may be a bake element, and the first predetermined period of time may be less than the second predetermined period of time. The first predetermined period of time may be in the range of about five seconds and the second predetermined period of time may be in the range of about forty seconds. The first and third predetermined periods of time may be the same and the second and fourth predetermined periods of time may be the same.

BRIEF DESCRIPTION OF THE DRAWINGS

In the drawings, like reference numerals refer to corresponding parts in the several views. To facilitate explanation, elements shown in the figures are not necessarily drawn to scale and may or may not be drawn in proportionate size to one another.

DETAILED DESCRIPTION OF THE DRAWINGS

Figure 1:
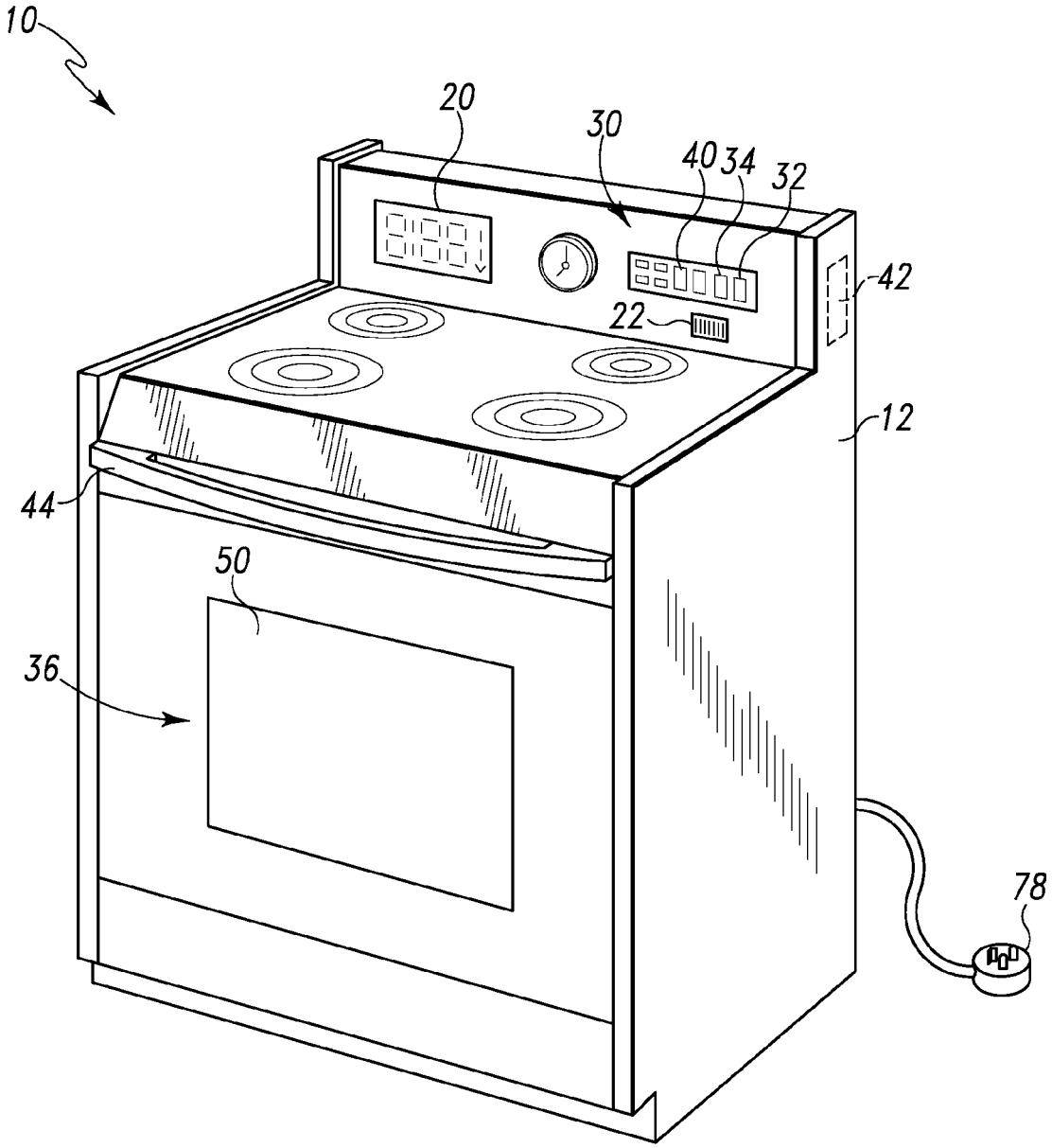
FIG. 1 is a perspective view of an exemplary oven.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Figure 2:
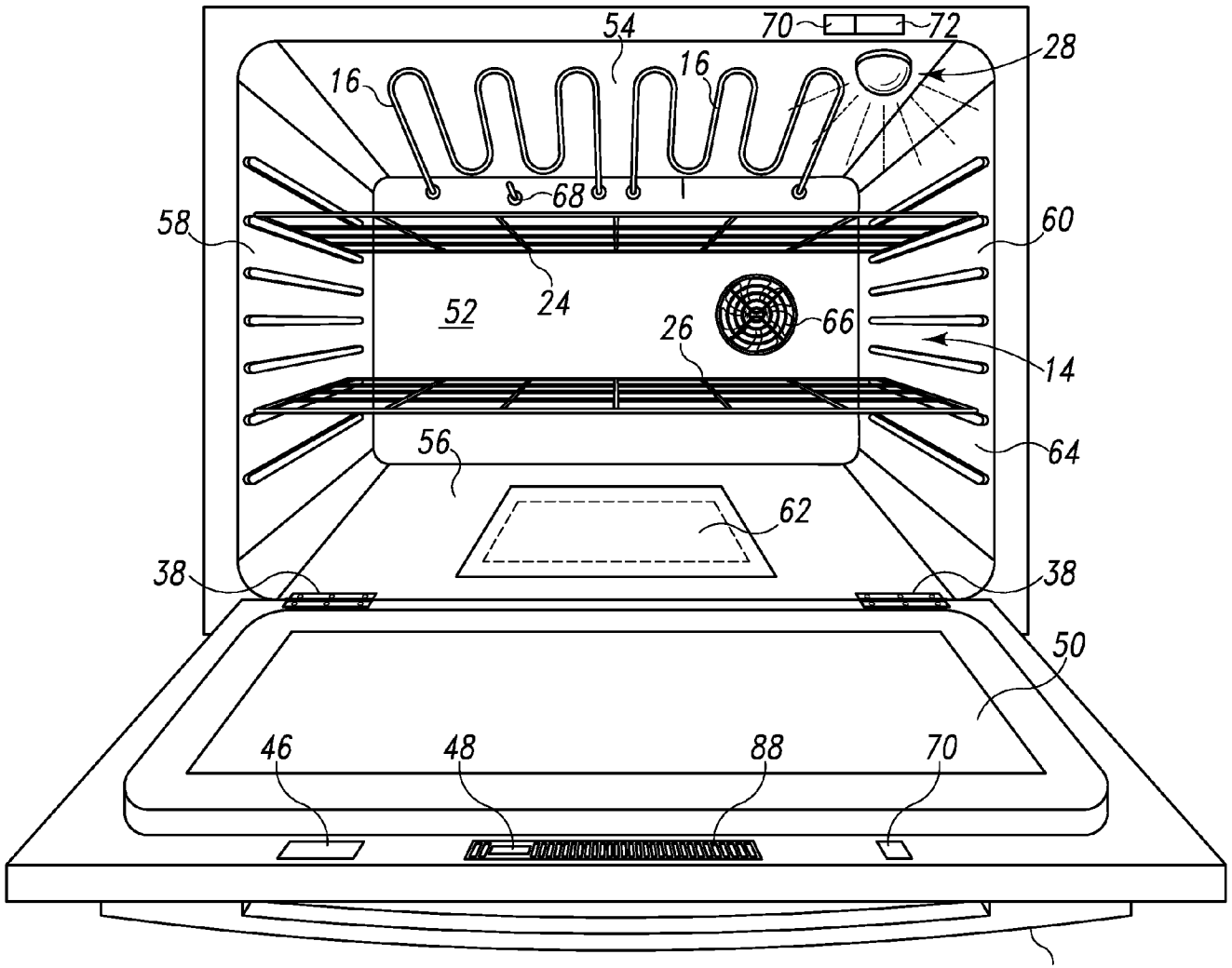
FIG. 2 is a partial perspective view of the oven of FIG. 1, with the oven door open.
Figure 3:
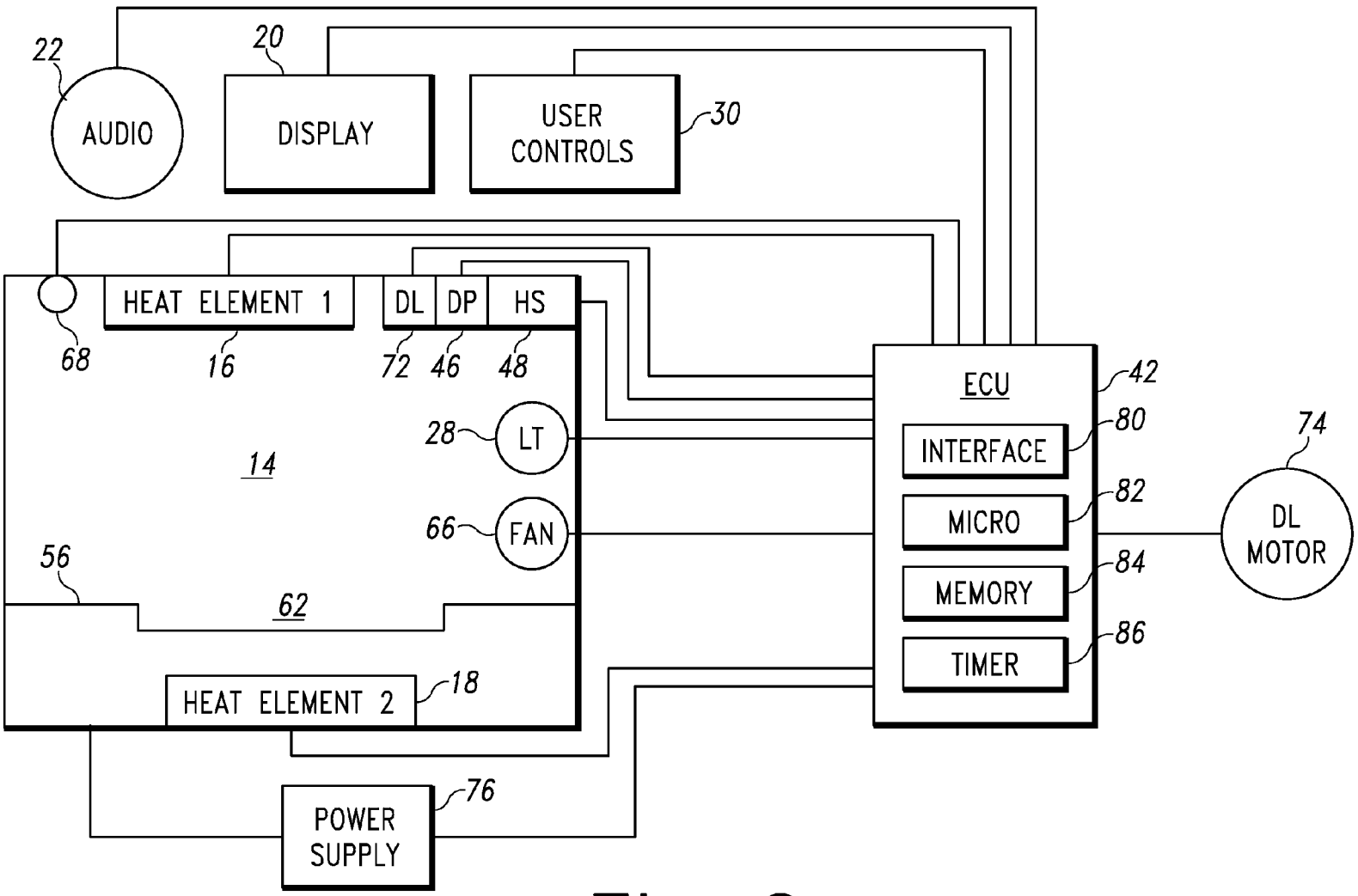
FIG. 3 is a schematic block diagram illustrating electrical connections between various oven components and the oven's electronic control unit.

Referring to FIGS. 1-3, an oven 10 has at least one low-temperature self-cleaning mode in which self-cleaning is accomplished using an oven temperature of less than six hundred degrees Fahrenheit. In the illustrated version of the oven 10, two alternative low-temperature self-cleaning modes are provided, where one of the modes is a steam-based self-cleaning mode and the other is a non-steam based low-temperature self-cleaning mode. The operation of these modes is described herein with reference to FIGS. 4-5.

In other versions of the oven 10, a pyrolytic self-cleaning mode (e.g. a mode in which an oven temperature of 600 degrees or higher is used) and a non-pyrolytic self-cleaning mode (e.g. a steam-based self-cleaning mode) may be provided. In still other versions of the oven 10, only one low-temperature self-cleaning mode (e.g. steam-based or non-steam) may be provided.

As illustrated, the oven 10 has a housing 12, an oven door 36, and a console 30. The housing 12 defines a cavity 14. The cavity 14 has a back wall 52, a top wall 54, a bottom wall 56, and a pair of opposing side walls 58, 60.

Each of the walls 52, 54, 56, 58, 60 has a heat-resistant coating 64. In the illustrated version of the oven 10, the heat-resistant coating 64 has a non-pyrolytic, hydrophilic enamel top layer facing the cavity 14. The non-pyrolytic enamel is an inorganic, non-porcelain, low-silica enamel, such as the finish currently known as AquaRealEase™ available from Ferro Corporation of Cleveland, Ohio.

During manufacture, a porcelain enamel is typically applied to the oven walls (e.g. steel), and then the non-pyrolytic enamel is applied on top of the porcelain enamel. In some versions of the oven 10, the total thickness of the coating 64, including the non-pyrolytic enamel and the porcelain enamel, is typically in the range of about four to about fourteen millimeters.

In versions of the oven 10 that are equipped with a pyrolytic self-cleaning mode in addition to a low-temperature self-cleaning mode, the coating 64 includes a conventional porcelain enamel finish without a non-pyrolytic top layer.

The oven 10 includes one or more heating elements 16 located adjacent the top wall 54. The oven 10 also includes one or more heating elements 18 located adjacent the bottom wall 56. The heating elements 18 may be hidden below the bottom wall 56 as shown schematically in FIG. 3. In other versions of the oven 10, the heating elements 18 may be located above the bottom wall 56, i.e. in the cavity 14.

The heating elements 16, 18 heat the cavity 14. Typically, the heating element or elements 16 have a higher wattage (e.g. up to about 40% more wattage) than the heating element or elements 18. In the illustrated version of the oven 10, the heating elements 16 are broil elements (used to broil or "top brown" food) while the heating elements 18 are bake elements (used for baking food).

A sump 62 is formed (e.g. stamped) in the bottom wall 56. The sump is configured to retain fluid used in the low-temperature self-cleaning modes of the oven 10. The low-temperature self-cleaning modes described herein use water in the sump 62, although other suitable fluids may be used. In the illustrations, the sump 62 is rectangularly shaped, although any other suitable shape may be used. In general, the sump 62 is configured to retain the maximum volume of fluid that may be needed for operation of the low-temperature self-cleaning mode (or modes) provided by the oven 10.

To support the non-steam low temperature self-cleaning mode of the oven 10, the sump 62 is configured to retain a volume of liquid in the range of about 2 cups or more (e.g. up to about 4 cups). In some versions of the oven 10, the sump 62 has a surface area that approaches the surface area of the bottom wall 56. For instance, in one implementation, the sump 62 resembles a shallow pan, having dimensions in the range of about twelve inches long by twelve inches wide by one inch deep.

The sump 62 is also used to retain the amount of fluid (e.g. water) needed to operate the steam-based low-temperature self-cleaning mode. This amount of fluid is typically smaller than the amount of fluid needed by the non-steam low-temperature self-cleaning mode (e.g. in the range of about ten ounces).

A number of oven racks 24, 26 are spaced from the heating elements 16, 18 and supported by the side walls 58, 60 of the cavity 14. An oven light 28 and optionally, a convection fan 66, are located in the cavity 14.

The oven door 36 is pivotably coupled to the housing 12 by a number of hinges 38 or similar coupling mechanisms. The oven door 36 includes a window 50, through which the contents of the oven may be viewed, and a handle 44, which facilitates opening and closing of the oven door 36. A vent 88 is also located on the oven door 36.

The console 30 supports controls for operating the oven 10, including one control 32 to activate one self-cleaning mode of the oven 10, another control 34 to activate another self-cleaning mode of the oven 10, and a start control 40, among others. These and other controls may take the form of tactile keys, membrane switches, toggle switches, buttons, dials, slides or other suitable control mechanisms.

As noted above, the oven 10 provides two different self-cleaning modes, each of which is activated by a separate user control 32, 34. In the illustrated version of the oven 10, two different non-pyrolytic self cleaning modes are provided. In this version, one of the user controls 32, 34 is used to select a steam-based non-pyrolytic self-cleaning mode, and the other of the user controls 32, 34 is used to, alternatively, select a different mode of low-temperature self-cleaning that does not involve the creation of steam. During the non-steam low-temperature self-cleaning mode, the temperature in the cavity 14 is less than the boiling point of water, but is sufficient to provide a moist environment in the cavity 14 without the use of steam. Such temperature is typically in the range of about 150 to about 170 degrees Fahrenheit.

In another version of the oven 10, one of the self-cleaning modes provides pyrolytic self-cleaning, while the other of the self-cleaning modes provides a type of lower-temperature (i.e. non-pyrolytic) self-cleaning in which steam is used to clean the cavity 14. In the pyrolytic self-cleaning mode, the cavity 14 is heated to a temperature of about 600 degrees Fahrenheit or more. During operation of the steam-based self-cleaning mode, the temperature in the cavity 14 is less than 600 degrees Fahrenheit, and is typically in the range of the boiling point temperature of water (e.g. 212 degrees Fahrenheit or 100 degrees Celsius).

In other versions of the oven 10, only the steam-based low temperature self-cleaning mode, or only the non-steam based low temperature self-cleaning mode, is provided. In these versions, one of the user controls 32, 34 is omitted, since the oven is equipped with only one self-cleaning mode.

The console 30 also supports a display 20 and an audio annunciator (e.g. a speaker) 22. The display 20 provides a variety of text messages, graphical icons and other indicators to inform the user of the status of the oven 10. The audio annunciator 22 outputs an audible signal (e.g. a "beep") to alert the user to a condition of the oven, or to prompt the user to take an action relating to operation of the oven.

The user controls 35, 34, 40, the display 20, and the audio annunciator 22 are in electrical communication with a source of electrical power, and with an electronic control unit 42. As illustrated, the electronic control unit 42 is mounted in the console 30; however, it may be installed at any suitable location within the oven 10.

The electronic control unit 42 receives and interprets electrical signals issued by sensing or detecting components of the oven 10 (e.g., electronic or electromechanical sensors, switches, relays and the like), and activates or energizes electronic or electromechanical components associated with the oven 10 (e.g. an oven light, fan, door lock, or heating element), as shown schematically in FIG. 3.

In general, the electronic control unit 42 performs computer operations, such as reading data, calculating values, counting elapsed time, executing pre-programmed logic, and comparing data to predetermined values, either continuously or intermittently, during operation of the oven 10. Accordingly, the electronic control unit 42 includes a printed circuit board assembly with an interface 80, a microcontroller or microprocessor ("micro") 82, a memory 84, and a timer 86, as well as other electronic components commonly utilized in the control of electromechanical systems.

The interface 80 includes electrical signal processing circuitry. The signal processing circuitry typically includes an analog-to-digital converter (ADC), which converts signals from analog devices in the oven 10 (e.g. the temperature sensor 68, and the humidity sensor 48, if they generate an analog output signal), into digital signals that are suitable for presentation to an input of the micro 82. The interface 80 also typically includes a digital-to-analog converter (DAC), which converts digital signals output by the micro 82 into an analog form that can be received by the analog devices. The ADC and/or DAC may be embodied as a discrete device or number of devices, or may be integrated into the micro 82. Some or all of the sensors used in the oven 10 may generate a digital output signal, in which case the ADC and DAC may be bypassed or omitted. Additional signal processing and/or signal conditioning devices (e.g. filters) may be incorporated into the interface 80, as well.

The memory 84 includes a programmable non-volatile storage device (e.g. electrically erasable programmable read-only memory or EEPROM), in which computer routines (e.g. firmware or software) executable by the micro 82, as well as certain control parameters used in the operation of the oven 10, are stored.

A number of sensors and/or switches are located in or near the cavity 14 of the oven 10. A temperature sensor 68 is supported by the back wall 52. The temperature sensor 68 periodically senses the ambient temperature in the cavity 14 and sends temperature signals to the electronic control unit 42. In the illustrated example, the temperature sensor 68 is a resistive sensor, such as a platinum Resistance Temperature Detector (RTD) sensor, although another suitable type of temperature sensor may be used.

An optional humidity sensor 48 is illustratively located in the vent 88 of the oven door 36. The humidity sensor 48 detects humidity in the cavity 14 and sends humidity signals to the electronic control unit 42.

The illustrated version of the oven 10 includes a door lock mechanism, although such a mechanism is not required if the oven is not equipped with a pyrolytic self-cleaning mode. The door lock mechanism includes a door lock 70 and a door lock sensor 72.

The door lock 70 has one portion located on the door 36 and a mating portion located on the front of the housing 12 (e.g. adjacent the top wall 54), so that when the lock is enabled, the door lock 70 prevents the door 36 from being opened once the door is closed. The operation of the door lock 70 is driven by a motor 74 controlled by the electronic control unit 42. The door lock sensor 72 sends a door locked signal to the electronic control unit 42 detects when the door lock 70 is engaged. In the illustrated version of the oven 10, the door lock sensor 72 is an electrical binary switch that closes when the door is locked.

The oven 10 also includes a door position sensor 46. The door position sensor 46 senses when the door 36 is closed, i.e. flush against the front of the housing 12, and sends a door closed signal to the electronic control unit 42. The door position sensor 46 is typically not connected to the door lock 70. As such, the door position sensor 46 is used in versions of the oven 10 that do not have a door lock, but may be used in versions of the oven 10 that do have a door lock, as well. In the illustrated version of the oven 10, the door position sensor 46 is an electrical binary switch that closes when the door is closed.

Electricity is normally supplied by connecting the oven 10 to an external power source, e.g., a wall outlet, by a connector 78. However, one or more of the electrically-driven features of the oven 10 may be powered by an alternative source. For example, electronic control unit 42 and/or other features may be operably connected to an internal power supply 76 (e.g. a battery) as needed for normal operation or to remain operational if the main power source becomes unavailable.

The low-temperature self-cleaning mode(s) of the oven 10 are controlled by the electronic control unit 42. The electronic control unit 42 executes computer routines stored in the memory 84 to perform the steps shown in FIGS. 4-5. Certain parameters that are used during the operation of the low-temperature self-cleaning modes are configurable during manufacture or installation of the oven (e.g. based on specifications and/or performance characteristics of the oven). These parameters are stored in the memory 84 so that they are not erased when the electrical power is shut off, and they may be updated at a later time (e.g. by a technician). These parameters include data values for the maximum oven temperature, heating and cooling times, and heating element cycling times associated with the low-temperature self-cleaning modes. These parameters are accessed by the micro 82 at various times during execution of the low-temperature self-cleaning routines.

Figure 4:
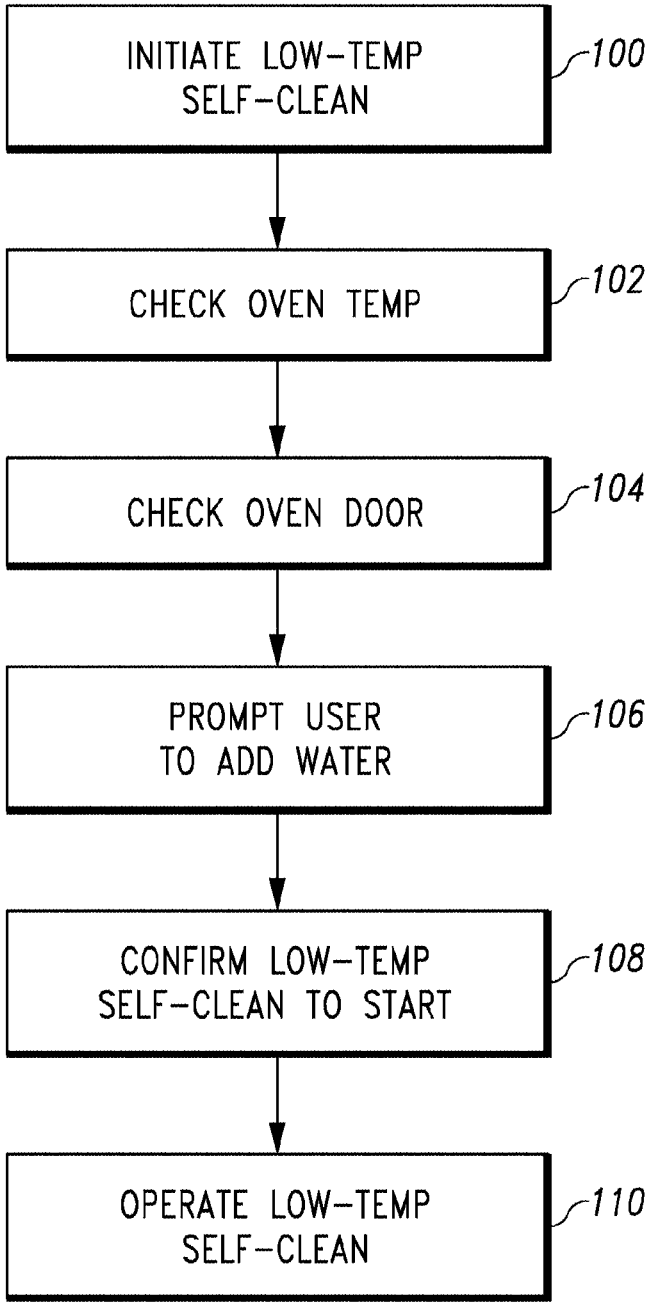
FIG. 4 is a flow diagram showing steps of a low-temperature self cleaning method of the oven of FIG. 1.

Referring to FIG. 4, the electronic control unit 42 executes an initiate low-temperature self-cleaning routine 100 upon receipt of a signal from one of the user controls 32, 34. If the oven 10 includes more than one low-temperature self-cleaning mode, the routine 100 determines which mode has been selected by the user (e.g. based on a characteristic of the signal or the location of the input). Upon determining the selected mode, the routine 100 accesses the stored parameters associated with the selected mode.

A check oven temperature routine 102 is executed to make sure that the temperature in the cavity 14 is not too high, i.e. higher than the maximum temperature specified for operation of the selected self-cleaning mode. For the steam-based low-temperature self-cleaning mode, the maximum temperature is in the range of about the boiling point of water. For the non-steam low-temperature self-cleaning mode, the maximum temperature is below the boiling point of water. If the oven temperature is higher than the specified maximum temperature, the routine 102 outputs a "TOO HOT" indicator to the display 20 and/or the audio annunciator 22. The routine 102 may then either cancel the selected low-temperature self-cleaning mode, or wait a period of time and re-check the oven temperature.

If the temperature in the cavity 14 falls within the specified range for the selected low-temperature self-cleaning mode, the routine 104 checks the status of the oven door 36. If the oven 10 is equipped with a pyrolytic self-cleaning mode and a non-pyrolytic self-cleaning mode, the routine 104 checks to see if the door lock is enabled by looking for a signal from the door lock sensor 72. If the door lock is enabled, the routine 104 disables the door lock during the low-temperature self-cleaning mode.

Another portion of the routine 104 checks whether the door 36 is closed by looking for an input signal from the door position sensor 46. If the door is open, the routine 104 issues a "CLOSE DOOR" indicator to the display 20 and/or the audio annunciator 22. The routine 104 may then either cancel the selected low-temperature self-cleaning mode, or wait a period of time and re-check the door position. The door position portion of the routine 104 may be executed after the routine 106, described below.

The routine 106 issues a prompt on the display 20 to the user to "ADD WATER" to the sump 62. The routine 106 may also issue an audible signal via the audio annunciator 22. The routine 106 may then wait for a signal from the humidity sensor 48 indicating that water has been added to the sump 62, or may simply wait a period of time for water to be added to the sump.

If the humidity sensor 48 indicates water in the sump 62, or a predetermined period of time has elapsed since the "ADD WATER" prompt was issued, and the door position sensor 46 indicates that the oven door is closed, the routine 108 displays a prompt on the display 20 to the user to "PRESS START." The routine 108 may also issue an audible signal via the audio annunciator 22. When the routine 108 detects that the start control 40 has been actuated by the user (i.e. by having received a signal from the control 40), the operate low temperature self-clean routine 110 is executed.

Figure 5:
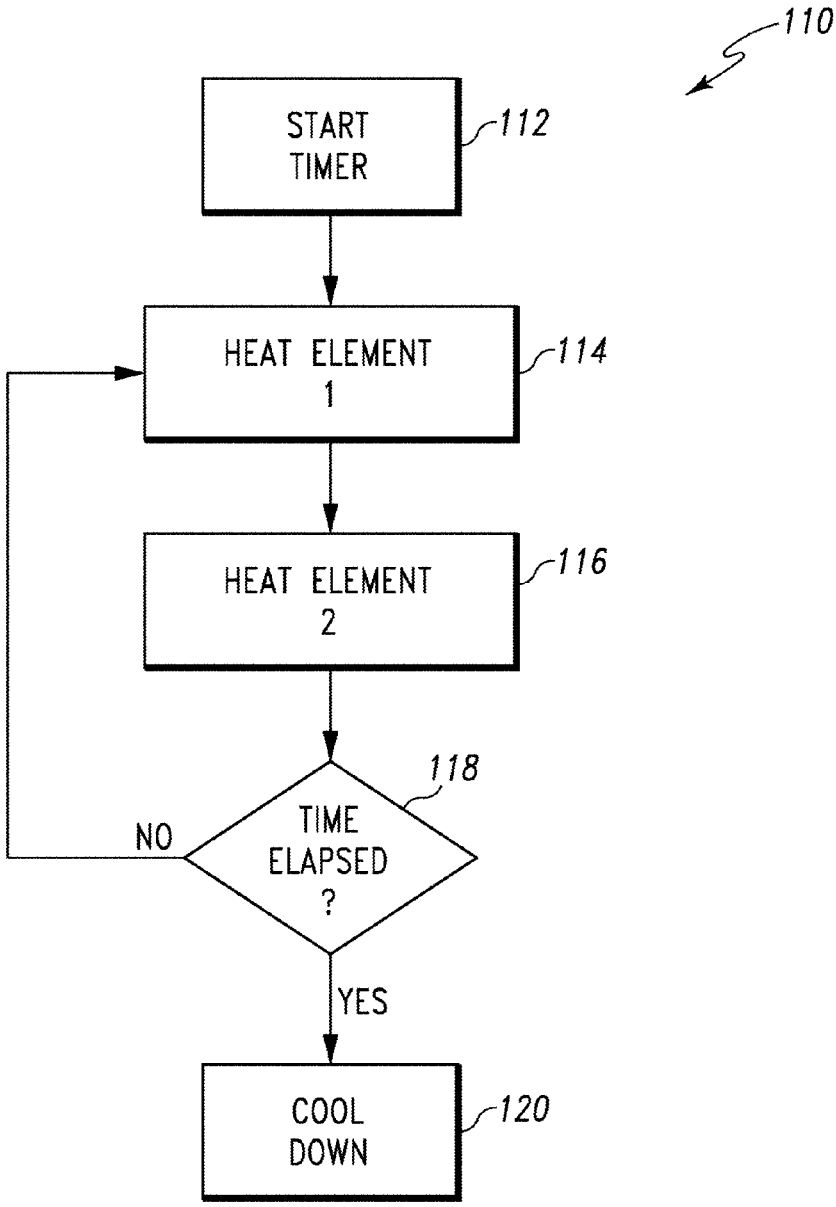
FIG. 5 is another flow diagram showing steps of the low-temperature self cleaning method of FIG. 4.

Referring to FIG. 5, the routine 110 controls the operation of the heating elements 16, 18 during the selected low-temperature self-cleaning mode. The routine 110 accesses the stored parameters to execute a pre-specified pattern of heating the cavity 14, first with one of the heating elements 16, 18, and then the other.

The routine 112 starts a timer (e.g. timer 86), which controls the duration of the heating phase of the low-temperature self-cleaning mode. The duration of the heating phase is specified as a stored parameter. For the steam-based low-temperature self-cleaning mode, the duration of the heating phase is generally in the range of about twenty minutes. For the non-steam low-temperature self-cleaning mode, the duration of the heating phase is generally in the range of about thirty minutes.

In the illustrated oven 10, the heating phase is divided into a preheat portion and a steady state portion. In the steam-based low-temperature self-cleaning mode, the broil element 16 is typically turned on for a longer period of time than the bake element 18, or it may be used exclusively, in the preheat portion of the heating phase.

In the steady state portion of the heating phase for the steam-based low-temperature self-cleaning mode, the heating elements 16, 18 are alternatingly turned on and off for approximately equal lengths of time. For example, in one implementation, the broil element 16 is turned on for a period of time in the range of about 40-50 seconds while the bake element 18 is turned off, and then the bake element 18 is turned on for a period of time in the range of about 40-50 seconds while the broil element 16 is turned off. The alternating heating by each of the elements 16, 18 continues until the heating phase is complete (as determined by the timer 86).

In the non-steam low-temperature self-cleaning mode, the broil element 16 is typically turned on for a shorter period of time than the bake element 18 in both the preheating and the steady state portions of the heating phase. For example, in one implementation, the broil element 16 is turned on for a period of time in the range of about 5 seconds while the bake element 18 is turned off, and then the bake element 18 is turned on for a period of time in the range of about 40 seconds while the broil element 16 is turned off. These cycle times are used in both the preheating and the steady state portions of the heating phase of the non-steam low temperature self cleaning mode. The alternating heating by each of the elements 16, 18 continues until the heating phase is complete (as determined by the timer 86).

The alternating use of the heating elements 16, 18 during the heating phase is illustrated by the routines 114, 116, and 118 of FIG. 5. In addition to the timer used to monitor the total duration of the heating phase, timers are used by each of the routines 114 and 116 to monitor the cycle times of the heating elements 16, 18 in accordance with the stored parameters.

A cool down phase follows the heating phase of the low-temperature self-cleaning mode. During the cool down phase, both of the heating elements 16, 18 are turned off, and the routine 120 outputs an "OVEN COOLING" indicator to the display 20 and/or the audio annunciator 22. In the steam-based low-temperature self-cleaning mode, the duration of the cool down phase is typically in the range of about ten minutes, such that the total duration of the steam-based low-temperature self-cleaning mode is in the range of about twenty minutes. In the non-steam low-temperature self-cleaning mode, the duration of the cool down phase is typically in the range of about thirty minutes, such that the total duration of the non-steam low-temperature self-cleaning mode is in the range of about sixty minutes. The routine 120 shuts off the heating elements 16, 18 and monitors the elapsed time of the cool down phase, in accordance with the stored parameters.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

For example, although a range oven is depicted in the drawings, it will be understood by those of skill in the art that the present invention is applicable to wall ovens, double ovens, convection ovens, and other types of ovens that have a need for a low-temperature self-cleaning feature.

There are a number of advantages of the present disclosure arising from the various features of the apparatus, system, and method described herein. It will be noted that alternative embodiments of the apparatus, system, and method of the present disclosure may not include all of the features described yet still benefit from at least some of the advantages of such features. Those of ordinary skill in the art may readily devise their own implementations of the apparatus, system, and method that incorporate one or more of the features of the present invention and fall within the spirit and scope of the present disclosure as defined by the appended claims.

The invention claimed is:

1. An oven comprising:

a housing defining a cavity, the cavity having a back wall, a top wall and a bottom wall spaced from the top wall by a pair of side walls, a door pivotably coupled to the housing, a non-pyrolytic coating on each of the back, top, bottom and side walls, and a user interface having a first user control operable to selectively activate a first non-pyrolytic self-cleaning cycle of the oven, and a second user control operable to selectively activate a pyrolytic self-cleaning cycle of the oven.

2. The oven of claim 1, wherein the non-pyrolytic coating comprises a hydrophilic enamel.

3. The oven of claim 2, wherein the non-pyrolytic coating further comprises a porcelain enamel between the hydrophilic enamel and each of the back, top, bottom and side walls.

4. The oven of claim 1, further comprising a sump sized to retain a volume of fluid in the range of about two cups or more.

5. The oven of claim 4, wherein the sump has a depth in the range of about one inch and a length in the range of about twelve inches.

6. The oven of claim 4, wherein the fluid is water, and further comprising:

a temperature sensor supported by the back wall of the cavity, and an electronic control unit, wherein the electronic control unit is configured to at least monitor temperature signals from the temperature sensor and maintain a temperature in the cavity of less than the boiling point temperature of a fluid in the sump during operation of the first non-pyrolytic-cleaning cycle of the oven.

7. The oven of claim 1, wherein the user interface further comprises a third user control operable to selectively activate the first non-pyrolytic self-cleaning cycle in a first mode in which fluid in the oven is heated to its boiling point temperature, or in a second mode in which fluid in the oven is heated to a maximum temperature that is less than the boiling point temperature of the fluid.

8. The oven of claim 7, further comprising a display that indicates which of the first non-pyrolytic and the pyrolytic self-cleaning cycles is activated.

9. The oven of claim 1, wherein the user interface further comprises a third user control operable to selectively activate the first non-pyrolytic self-cleaning cycle in a first mode having a first duration, or in a second mode having a second duration different than the first duration.

10. The oven of claim 1, further comprising a humidity sensor in the cavity.

11. The oven of claim 1, wherein the user interface further comprises a third user control operable to selectively activate a second non-pyrolytic self-cleaning cycle different than the first non-pyrolytic self-cleaning cycle.

12. The oven of claim 1, wherein the first user control is operable to selectively activate a second non-pyrolytic self-cleaning cycle different than the first non-pyrolytic self-cleaning cycle.

13. A method of operating an oven, the method comprising:

receiving from a user interface operable by a person either a first signal or a second signal;

when the first signal is received, activating a non-pyrolytic self-cleaning cycle performed by the oven; and when the second signal is received, activating a pyrolytic self-cleaning cycle preformed by the oven.

14. The method of claim 13, further comprising:

receiving from the user interface either a third signal or a fourth signal;

when the third signal is received, activating the non-pyrolytic self-cleaning cycle in a first mode in which fluid in the oven is heated to its boiling point temperature; and when the fourth signal is received, activating the non-pyrolytic self-cleaning cycle in a second mode in which the fluid in the oven is heated to a maximum temperature that is less than the boiling point temperature of the fluid.

15. The method of claim 13, further comprising:

receiving from the user interface either a third signal or a fourth signal;

when the third signal is received, activating the non-pyrolytic self-cleaning cycle in a first mode having a first duration; and when the fourth signal is received, activating the non-pyrolytic self-cleaning cycle in a second mode having a second duration different from the first duration.

16. The method of claim 13, further comprising displaying an indication of which of the pyrolytic self-cleaning cycle and the non-pyrolytic self-cleaning cycle is activated.

17. The method of claim 13, further comprising prompting a user to place a fluid in a sump of the oven for the non-pyrolytic self-cleaning cycle.

18. The method of claim 13, further comprising:

enabling a door lock when the pyrolytic self-cleaning cycle is activated; and disabling the door lock when the non-pyrolytic self-cleaning cycle is activated.

* * * * *